US012655754B2

(12) United States Patent
Nasr et al.

(10) Patent No.: US 12,655,754 B2
(45) Date of Patent: Jun. 16, 2026

(54) REAL-TIME ZONAL INFLOW ANALYZER WITH CLOSED-LOOP TRACER SYSTEM

(71) Applicant: SAUDI ARABIAN OIL COMPANY, Dhahran (SA)

(72) Inventors: Mohammed A. Nasr, Qatif (SA); Wail K. Aljehani, Alkhafji (SA); James Ohioma Arukhe, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 19/278,362

(22) Filed: Jul. 23, 2025

(65) Prior Publication Data

US 2025/0347219 A1 Nov. 13, 2025

Related U.S. Application Data

(62) Division of application No. 18/620,368, filed on Mar. 28, 2024, now Pat. No. 12,392,239.

(51) Int. Cl.
*E21B 47/11* (2012.01)
*E21B 43/14* (2006.01)
*E21B 49/08* (2006.01)

(52) U.S. Cl.
CPC ..... *E21B 47/11* (2020.05); *E21B 43/14* (2013.01); *E21B 49/08* (2013.01)

(58) Field of Classification Search
CPC ..... E21B 47/11; E21B 43/26; E21B 47/12; E21B 43/12; E21B 43/14; E21B 34/06; E21B 43/16; E21B 49/08
See application file for complete search history.

(56) References Cited

U.S. PATENT DOCUMENTS 10,415,382 B2 * 9/2019 Enkababian ..... E21B 47/11
11,384,636 B2 * 7/2022 Smithson ..... G01F 1/74
2013/0020088 A1 * 1/2013 Dyer ..... E21B 41/0035 166/373
2017/0321547 A1 * 11/2017 Enkababian ..... G01N 15/088

FOREIGN PATENT DOCUMENTS

WO WO-2019239201 A1 * 12/2019 ..... E21B 47/13

* cited by examiner

*Primary Examiner* — Zakiya W Bates
(74) *Attorney, Agent, or Firm* — Osha Bergman Watanabe & Burton LLP

(57) ABSTRACT

A real-time zonal inflow analysis system including a chemical analysis panel and a chemical tracer module disposed in each of a plurality of perforation zones in a well. The chemical tracer module produces a zonal signature of a corresponding perforation zone, where the zonal signature uniquely identifies the corresponding perforation zone. The chemical analysis panel includes an automated instrument and an integrated monitoring dashboard. The automated instrument obtains a production flow that includes a plurality of zonal contributions of the produced fluid from the plurality of perforation zones. The automated instrument measures, in the production flow, a concentration of the zonal signature of each perforation zone and determines, based on each concentration, a respective measure of each zonal contribution. The integrated monitoring dashboard displays the respective measure of each of zonal contribution to facilitate a production operation of the well.

13 Claims, 10 Drawing Sheets

300g

300h

REAL-TIME ZONAL INFLOW ANALYZER WITH CLOSED-LOOP TRACER SYSTEM

BACKGROUND

In the oil and gas industry, the assessment of production profiles, specifically zonal contributions, traditionally relies on production logging tools (PLTs) which necessitate well intervention. This conventional approach often incurs substantial operating expenses and faces numerous challenges, including complex logistics for both offshore and onshore operations, handling of heavy equipment, and risks associated with sour environments, e.g., hydrogen sulfide ($H_2S$) exposure. Additionally, there are risks of tool malfunctioning or being stuck during the intervention process.

Recent technological advancements have led to utilizing various downhole tracers that enable identification of zonal contributions without the need for well intervention. This method involves regular, timed manual sampling at the wellhead, followed by detailed laboratory analysis to detect specific tracer signatures and quantitatively determine zonal contributions. However, this technique, particularly in offshore settings, is subject to logistical challenges. Moreover, sampling in sour wells is constrained by the necessity to prevent $H_2S$ release.

SUMMARY

In general, in one aspect, disclosed embodiments relate to a method to perform zonal inflow analysis of a well. The method includes disposing a chemical tracer module in each of a plurality of perforation zones in the well, wherein the chemical tracer module interacts with produced fluid of the well to produce a zonal signature of a corresponding perforation zone, the zonal signature comprising a chemical reaction product of the chemical tracer module and the produced fluid to uniquely identify the corresponding perforation zone, obtaining, at a wellhead of the well, a production flow comprising a plurality of zonal contributions of the produced fluid from the plurality of perforation zones, measuring, in the production flow and using a chemical analysis panel at the Earth's surface, a concentration of the zonal signature of each of the plurality of perforation zones, determining, using at least the chemical analysis panel and based on the concentration of the zonal signature of each of the plurality of perforation zones, a respective measure of each of the plurality of zonal contributions, and facilitating, based on the respective measure of each of the plurality of zonal contributions, a production operation of the well.

In general, in one aspect, disclosed embodiments relate to a chemical analysis panel for performing zonal inflow analysis of a well. The chemical analysis panel includes an automated instrument disposed at the Earth's surface that obtains, at a wellhead of the well, a production flow comprising a plurality of zonal contributions of produced fluid from a plurality of perforation zones in the well, measures, in the production flow, a concentration of a zonal signature of each of the plurality of perforation zones, and determines, based on the concentration of the zonal signature of each of the plurality of perforation zones, a respective measure of each of the plurality of zonal contributions, wherein a chemical tracer module is disposed in each of the plurality of perforation zones that interacts with the produced fluid to produce the zonal signature of a corresponding perforation zone, the zonal signature comprising a chemical reaction product of the chemical tracer module and the produced fluid to uniquely identify the corresponding perforation zone, and an integrated monitoring dashboard that displays the respective measure of each of the plurality of zonal contributions to facilitate a production operation of the well.

In general, in one aspect, disclosed embodiments relate to a real-time zonal inflow analysis system. The real-time zonal inflow analysis system includes a chemical tracer module disposed in each of a plurality of perforation zones in a well, wherein the chemical tracer module interacts with produced fluid of the well to produce a zonal signature of a corresponding perforation zone, the zonal signature comprising a chemical reaction product of the chemical tracer module and the produced fluid to uniquely identify the corresponding perforation zone, a chemical analysis panel disposed at the Earth's surface and comprising an automated instrument that obtains, at a wellhead of the well, a production flow comprising a plurality of zonal contributions of the produced fluid from the plurality of perforation zones, measures, in the production flow, a concentration of the zonal signature of each of the plurality of perforation zones, and determines, based on the concentration of the zonal signature of each of the plurality of perforation zones, a respective measure of each of the plurality of zonal contributions, and an integrated monitoring dashboard that displays the respective measure of each of the plurality of zonal contributions to facilitate a production operation of the well.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (for example, first, second, third) may be used as an adjective for an element (that is, any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In general, embodiments of the disclosure include a method and system for monitoring and analyzing zonal inflows in oil and gas wells by incorporating a surface chemical analysis panel in the well system. This system includes a surface computer equipped with a chemical analysis instrument capable of identifying the type and concentration of polymers in the produced fluid. The tracers are integral to the well's downhole completion and directly interact with the produced fluid. This interaction triggers a reaction of the produced fluids with the zone-specific tracers to produce a zonal signature, which is analyzed at the surface panel to quantify the zonal contribution from each zone. Accordingly, manual sample collection and analysis at the surface are eliminated. The surface chemical analysis panel chemically identifies the zonal signature components (e.g., polymer concentration and type) in the produced fluid to facilitate on-site analysis using a real-time monitoring dashboard.

Figure 1A:
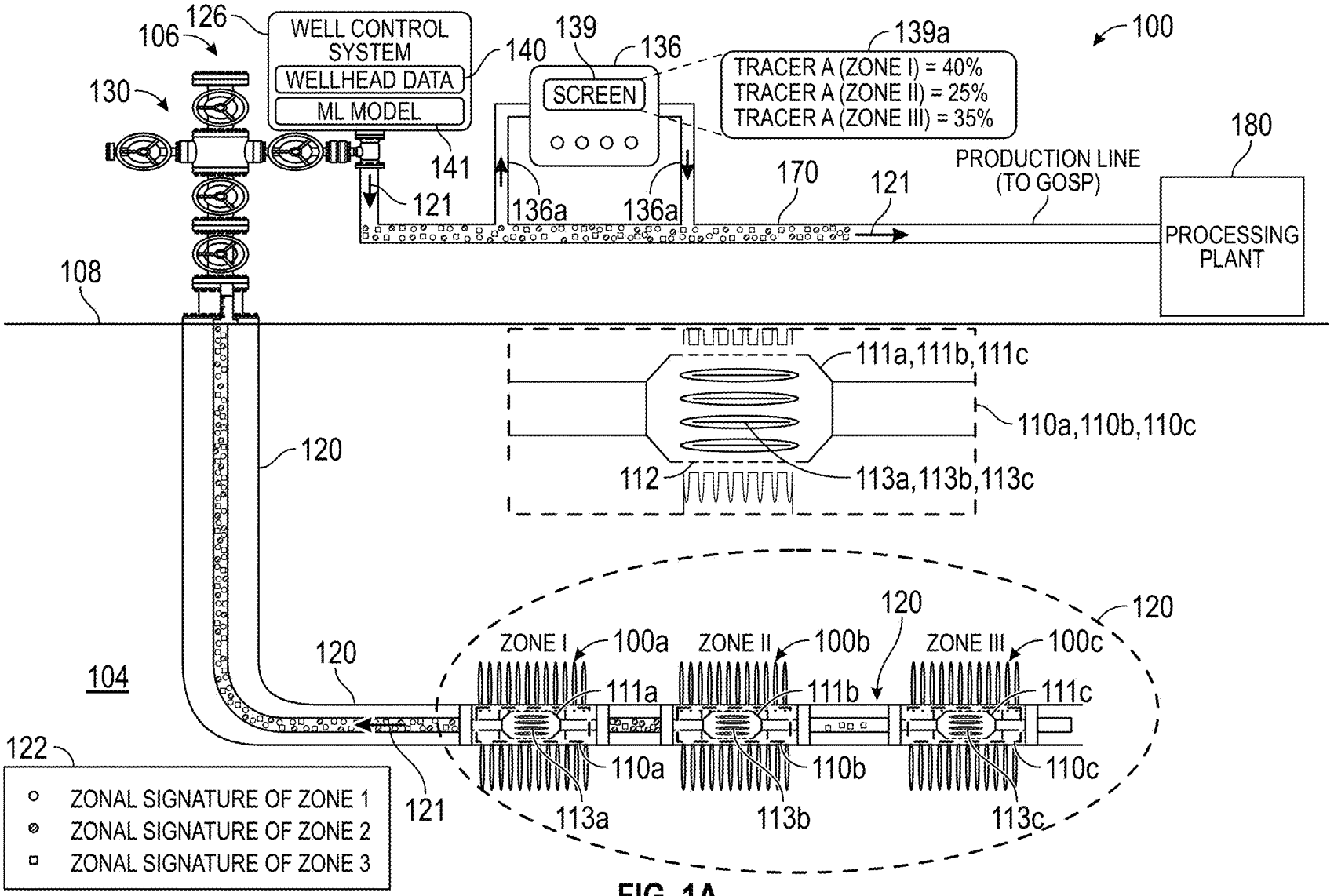
FIGS. 1A, 1B, and 1C show a system in accordance with one or more embodiments.

FIG. 1A shows a schematic diagram in accordance with one or more embodiments. More specifically, FIG. 1A illustrates a well environment (100) that includes a hydrocarbon reservoir ("reservoir") (102) located in a subsurface hydrocarbon-bearing formation ("formation") (104) and a well system (106). The hydrocarbon-bearing formation (104) may include a porous or fractured rock formation that resides underground, beneath the Earth's surface ("surface") (108). In the case of the well system (106) being a hydrocarbon well, the reservoir (102) may include a portion of the hydrocarbon-bearing formation (104). The hydrocarbon-bearing formation (104) and the reservoir (102) may include different layers of rock (referred to as formation layers) having varying characteristics, such as varying degrees of permeability, porosity, capillary pressure, and resistivity. In the case of the well system (106) being operated as a production well, the well system (106) may facilitate the extraction of hydrocarbons (or "production") (121) from the reservoir (102). For example, the production (121) may be transported to a processing plant (180) from the well system (106) via a pipeline network (170).

In some embodiments, the well system (106) includes a wellbore (120), a wellhead (130), a well control system ("control system") (126), and a surface chemical analysis panel (136). The control system (126) may control various operations of the well system (106), such as well production operations, well completion operations, well maintenance operations, and reservoir monitoring, assessment and development operations. In some embodiments, the control system (126) includes a computer system that is the same as or similar to that of the computer system (400) described below in FIG. 4 and the accompanying description. The chemical analysis panel (136) includes chemical analysis instruments, hardware circuitry, and software that collectively analyze chemical contents of the production (121) to identify chemical compounds, concentrations, and other properties detected in the production (121).

Example chemical analysis instruments of the chemical analysis panel (136) are listed below with brief description of functionality and response time characteristics.

Gas Chromatograph (GC)
- Functionality: Separates and analyzes compounds that can be vaporized without decomposition. Commonly used to identify and quantify different substances within a test sample.
- Response Time: Depending on the complexity of the sample, the analysis can range from a few minutes to an hour.

High-Performance Liquid Chromatography (HPLC)
- Functionality: Separates, identifies, and quantifies components in a liquid mixture. It is widely used for analyzing organic compounds that are not volatile or may decompose at high temperatures.
- Response Time: Typically ranges from 5 to 30 minutes per analysis.

Mass Spectrometer (MS)
- Functionality: Measures the masses within a sample by ionizing chemical species and sorting the ions based on their mass-to-charge ratio. It is often coupled with GC or HPLC for detailed molecular analysis.
- Response Time: Can be rapid, often seconds to minutes, especially when coupled with chromatography techniques for real-time analysis.

Fourier-Transform Infrared Spectroscopy (FTIR)
- Functionality: Obtains an infrared spectrum of absorption or emission of a solid, liquid, or gas. It is used for identifying organic, polymeric, and, in some cases, inorganic materials.
- Response Time: Near-instantaneous measurements; the spectrum is typically obtained in less than a second.

Ultraviolet-Visible Spectrophotometry (UV-Vis)
- Functionality: Measures the absorbance of UV or visible light by a chemical solution, which can indicate the concentration of specific molecules.
- Response Time: Analysis time can be very quick, often just a few seconds per sample.

Nuclear Magnetic Resonance Spectroscopy (NMR)
- Functionality: Uses the magnetic properties of certain atomic nuclei to determine physical and chemical properties of atoms or the molecules in which they are contained.
- Response Time: Varies widely depending on the type of NMR and the complexity of the sample, ranging from minutes to hours.

Inductively Coupled Plasma Mass Spectrometry (ICP-MS).
- Functionality: Detects metals and some non-metals at very low concentrations using mass spectrometry. This device can identify both metals and a range of non-metals in liquid samples at extremely low concentration levels.
- Response Time: Sample introduction and washout take a few minutes, while the detection can occur in a matter of seconds.

X-Ray Fluorescence (XRF)
- Functionality: Analyzes the fluorescent X-ray emitted from a sample when it is excited by a primary X-ray source. This technique is used for the elemental analysis of materials.
- Response Time: Can be very fast, with some instruments providing near real-time analysis.

Electron Microprobe
- Functionality: Uses focused beams of electrons to generate X-rays from a sample for elemental analysis. It is used for detailed mapping of chemical compositions at small scales.
- Response Time: Depending on the mapping area and desired resolution, it can take from minutes to hours.

Flame Photometer
- Functionality: Measures the concentration of certain metal ions, like sodium, potassium, and calcium, in a sample. The sample is introduced into a flame, and the intensity of color is used to determine the concentration.
- Response Time: A few seconds to a couple of minutes per sample.

The choice of instrument and the response time required depends on the specific application, the complexity of the sample, the concentration of the analytes of interest, and the required precision and accuracy of the measurements.

Figure 1B:
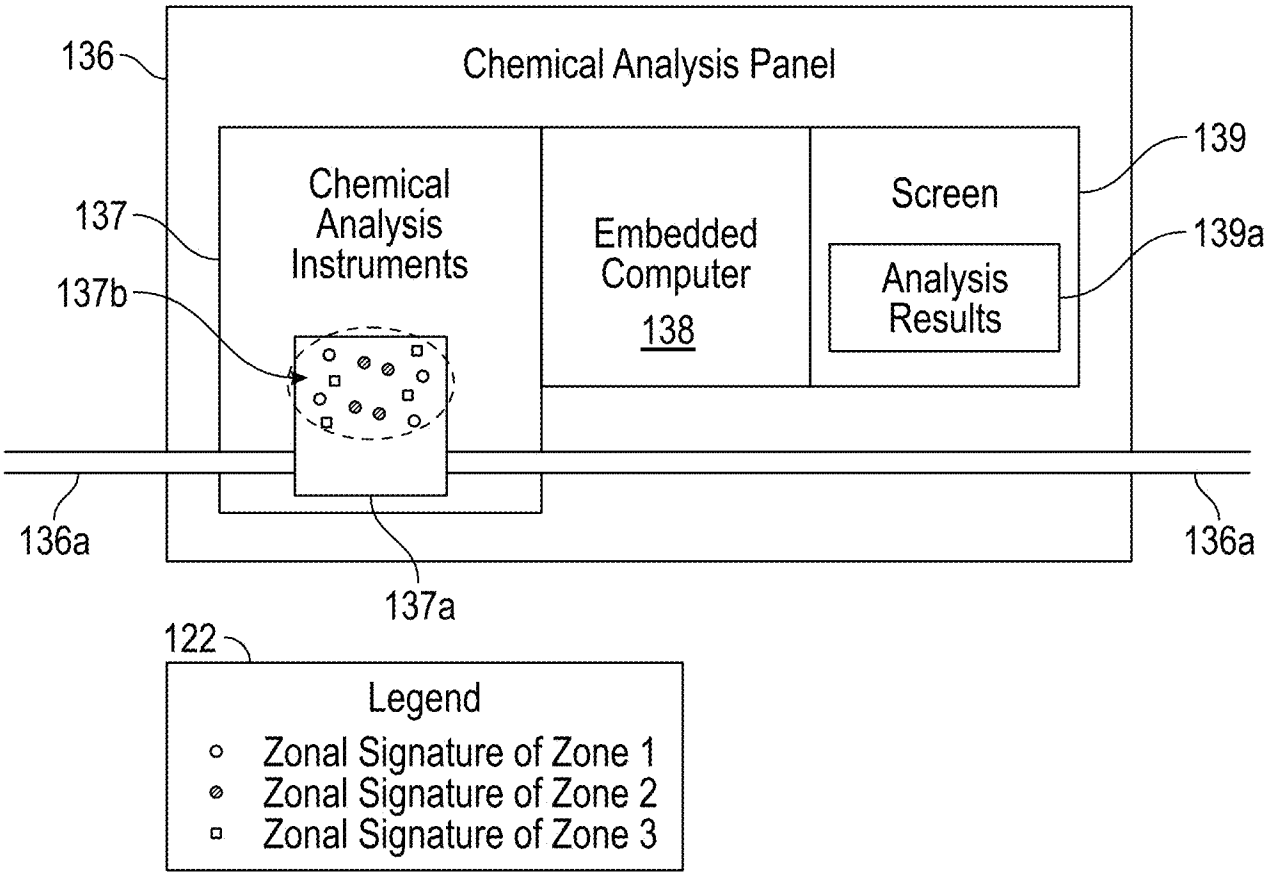
Figure 1C:
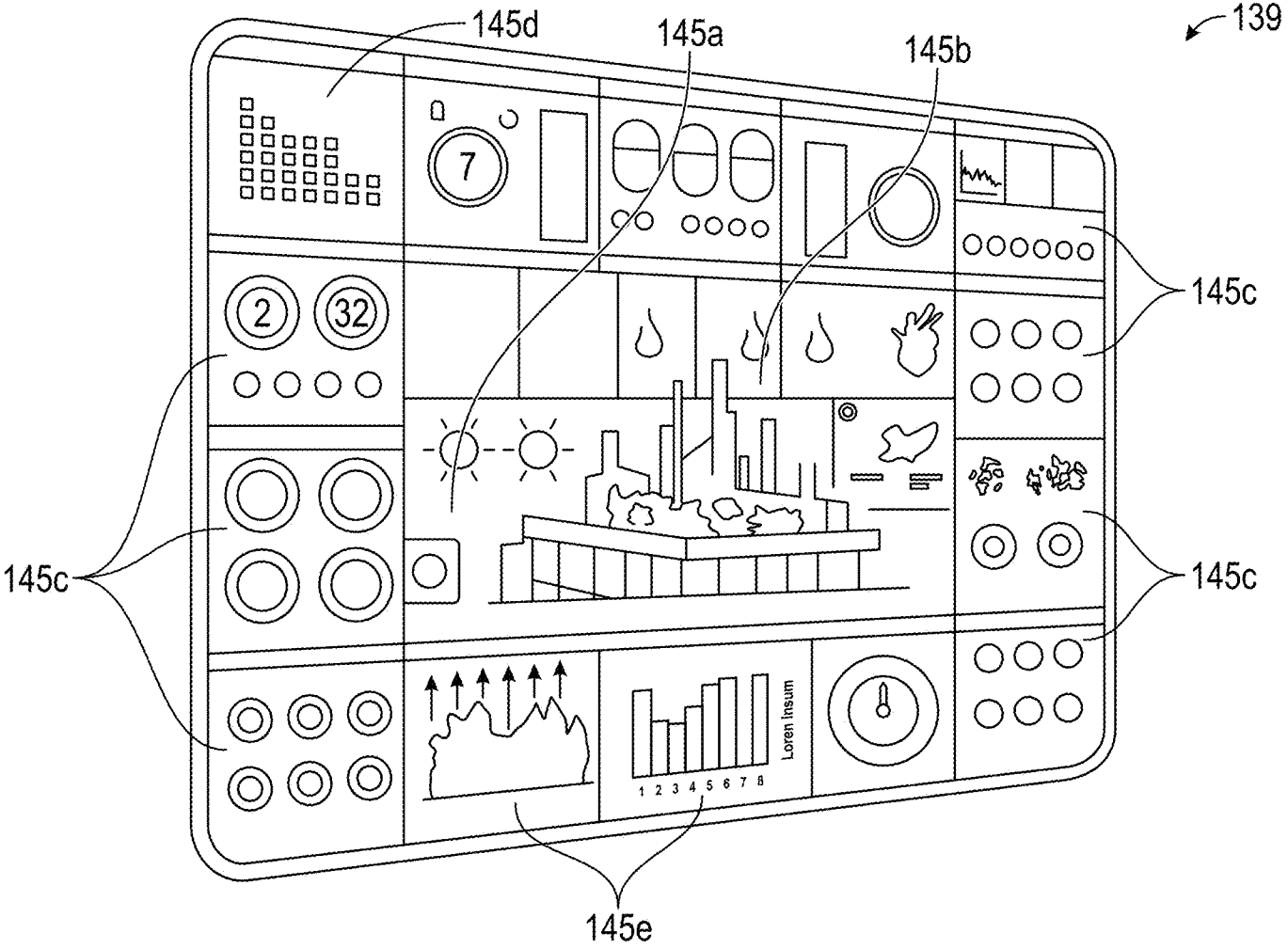

As shown in FIG. 1A, a portion of the production (121) is diverted along a pipeline (136*a*) to the chemical analysis panel (136) as a representative sample for analysis. FIG. 1B shows details of the chemical analysis panel (136). As shown in FIG. 1B, the chemical analysis panel (136) includes chemical analysis instruments (137) having an analysis chamber (137*a*) for analyzing the production sample (137*b*), an embedded computer (138) having hardware circuitry and software for generating analysis results (139*a*), and a display screen (139) for displaying the analysis results (139*a*). In some embodiments, the chemical analysis panel (136) also includes an automated sampling mechanism to retrieve the representative production sample into the analysis chamber (137*a*) of the chemical analysis panel (136) without human intervention. The analysis results (139*a*), e.g., chemical compound names, percentage concentrations, etc., may be displayed in real-time on the screen (139) of the chemical analysis panel (136). In this context, the screen (139) is referred to as a live dashboard or a real-time dashboard. An example live dashboard (139) is shown in FIG. 1C where text and/or graphical elements (145*a*, 145*b*, 146*c*) represent the well system (106), processing plant (180), respective control settings, and the analysis results (139*a*) are shown as chemical compound names (145*d*), percentage concentrations (145*e*), etc. In some embodiments, the analysis results (139*a*) are monitored by a user (e.g., wellsite operator) as a basis to adjust the operation of the well system (106), e.g., via the well control system (126). In some embodiments, the analysis results (139*a*) are automatically transmitted to and monitored by the well control system (126) as a basis to automatically adjust the operation of the well system (106), e.g., based on a machine learning algorithm.

The wellhead (130) may include a rigid structure installed at the "up-hole" end of the wellbore (120), at or near where the wellbore (120) terminates at the Earth's surface (108). The wellhead (130) may include structures for supporting (or "hanging") casing and production tubing extending into the wellbore (120). Production (121) may flow through the wellhead (130), after exiting the wellbore (120). In some embodiments, the wellhead (130) includes flow regulating devices that are operable to control the flow of substances into and out of the wellbore (120). For example, the wellhead (130) may include one or more production valves that are operable to control the flow of production (121). For example, a production valve may be fully opened to enable unrestricted flow of production (121) from the wellbore (120), the production valve may be partially opened to partially restrict (or "throttle") the flow of production (121) from the wellbore (120), and the production valve may be fully closed to fully restrict (or "block") the flow of production (121) from the wellbore (120), and through the wellhead (130).

The wellbore (120) may include a bored hole that extends from the surface (108) into a target zone of the hydrocarbon-bearing formation (104), such as the reservoir (102). The wellbore (120) may facilitate the circulation of drilling fluids during drilling operations, the flow of hydrocarbon production ("production") (121) (e.g., oil and gas) from the reservoir (102) to the surface (108) during production operations, the injection of substances (e.g., water) into the hydrocarbon-bearing formation (104) or the reservoir (102) during injection operations, or the communication of monitoring devices (e.g., logging tools) into the hydrocarbon-bearing formation (104) or the reservoir (102) during monitoring operations (e.g., during in situ logging operations).

In some embodiments, the wellbore (120) includes a downhole completion with perforations allowing hydrocarbons to flow into the wellbore (120) from the formation rock layers in the reservoir (102). In the example shown in FIG. 1A, produced fluid (e.g., hydrocarbons) flow from a first portion (i.e., zone 1 or zone I) of the reservoir (102) through the perforation A (100*a*) into the wellbore (120), referred to as the zonal contribution of zone 1. Similarly, produced fluid flow from a second portion (i.e., zone 2 or zone II) of the reservoir (102) through the perforation B (100*b*) into the wellbore (120) and produced fluid flow from a third portion (i.e., zone 3 or zone III) of the reservoir (102) through the perforation C (100*c*) into the wellbore (120) are referred to as zonal contributions from zone 2 and zone 3, respectively. In this context, perforation A (100*a*), perforation B (100*b*), and perforation C (100*c*) are also referred to as perforation zone 1, perforation zone 2, and perforation zone 3, respectively. Similarly, sections of the wellbore (120) corresponding to perforation zone 1, perforation zone 2, and perforation zone 3 are also referred to as zone 1, zone 2, and zone 3, respectively. In other words, depending on the context, the terms zone 1, zone 2, and zone 3 may refer to a corresponding portion of the reservoir, a corresponding wellbore section, or a corresponding perforation.

In some embodiments, a chemical tracer module is installed in each perforation zone. As shown in FIG. 1A, the chemical tracer modules (110*a*, 110*b*, 110*c*) are installed in perforation zone 1, perforation zone 2, and perforation zone 3, respectively. In some embodiments, the chemical tracer modules (110*a*, 110*b*, 110*c*) are integrated with the downhole completion (e.g., a production casing) of the wellbore (120).

In one or more embodiments, integrating chemical tracer modules into a wellbore is achieved using a mechanical structure of specialized carriers or containers that are part of the well's completion hardware. The mechanical structure of such an integration may involve several components to ensure that the tracers are securely positioned and can interact with the produced fluids to provide the desired surveillance data. Examples of these components are described below.

- Tracer Carriers or Containers: These are specially designed tools that house the chemical tracers. They are built to withstand the harsh downhole environment, including high pressures and temperatures.
- Perforated Liners: Tracers are often placed adjacent to or within perforated liners. The perforations allow reservoir fluids to flow into the wellbore, passing through the tracer carriers where the tracers can then mix with the fluids.
- Swellable Packers: Swellable packers are used to isolate sections of the wellbore. Tracer modules can be installed above these packers so that when the packers swell and isolate the wellbore sections, the tracers are trapped in the designated zones.
- Downhole Clamps or Anchors: These mechanical devices secure the tracer carriers to the inside of the wellbore casing or tubing, preventing movement due to fluid flow or other downhole activities.
- Carrier Deployment Tools: These tools are used to lower the tracer carriers into the wellbore to the desired depth. They can be run on wireline, coiled tubing, or integrated into the drill string during well completion.

Control Lines: In more advanced systems, tracers might be released or activated via control lines that run from the surface to the tracer module. These allow for remote actuation of tracer release.

Ports and Valves: Some tracer modules may have ports that are opened either mechanically or via remote control to initiate tracer release. Check valves can also be used to prevent backflow and ensure one-way interaction with reservoir fluids.

Chemical Injection Mandrels: These are part of the completion string and are used when continuous or controlled release of tracers is required. They allow for the injection of tracers at specific points along the wellbore.

Downhole Sensors: In conjunction with tracer modules, sensors can be installed to measure the flow rate, temperature, and other parameters that are critical for interpreting tracer data.

In one or more embodiments, integrating chemical tracer modules into a wellbore includes the following considerations:

Accessibility for Installation: The mechanical structure allows for easy installation during well completion or through well intervention techniques.

Compatibility with Fluids: Materials used in the construction of the tracer module and its mechanical couplings are compatible with reservoir fluids and stimulation chemicals to avoid degradation.

Reservoir Conditions: The mechanical structure is able to withstand the specific temperature, pressure, and chemical environment of the reservoir.

Data Retrieval: The mechanical structure facilitates efficient interaction between the tracers and the produced fluids to ensure that accurate data is captured for analysis.

The exact mechanical structure and method of integration may vary depending on the specific well design, the objectives of the monitoring program, and the types of tracers used.

Details of each of the chemical tracer modules (110*a*, 110*b*, 110*c*) are shown in the expanded view (110*a*, 110*b*, 110*c*) where zonal tracers (113*a*, 113*b*, 113*c*) are stored in respective enclosures (111*a*, 111*b*, 111*c*). The zonal tracers are pieces of chemical or other materials that are unique to the individual zones. These zonal tracers are chosen based on stability, detectability, and resistance to the downhole environment's harsh conditions such as temperature and pressure. Examples of chemical or other materials used as zonal tracers are described below.

Oil-Soluble Tracers: These are often used for oil phases and can include chemicals like perdeuterated hydrocarbons which have a distinct chemical signature detectable at low concentrations.

Water-Soluble Tracers: For the water phase, tracers like naphthalene sulfonates or halogenated benzenes might be used, as they are easily detectable in water and can be uniquely identified.

Gas Tracers: Perfluorocarbons are a common choice for gas tracers due to their stability and the ease with which they can be measured at trace levels.

Radioactive Tracers: Isotopes such as Iodine-131 or Tritium can be used in very controlled and regulated amounts for their distinct radioactive signatures.

Fluorescent Dyes: These are used for their bright and distinct colors under UV light, with each dye having a unique fluorescent spectrum.

Encapsulated Tracers: These are tracers that are enclosed in a protective shell or coating that degrades at a controlled rate, releasing the tracer over time. The composition of the shell material can be unique for each zone.

Magnetic Tracers: Particles with unique magnetic signatures can be used and detected by their influence on magnetic fields.

Nano-Tracers: These can be engineered to have unique surface properties or shapes that are detectable and distinguishable from other particles.

Isotope Ratio Tracers: Naturally occurring isotopes can be used in ratios that create a unique fingerprint for each zone.

Chemical Isomers: Using different isomers of a chemical compound can provide a unique tracer for each zone, as each isomer will have different physical or chemical properties.

For the tracers to be useful, they are not only be unique but also inert to reactions with the reservoir rock or fluids, and their detection methods must be sensitive, accurate, and reliable over the life of the well. The specific tracers used would be selected based on the compatibility with the reservoir's conditions and the objectives of the monitoring program.

As the produced fluids in the wellbore (120) flow through each zone and successively enter the enclosures (111*a*, 111*b*, 111*c*) through respective openings (112), the produced fluids successively interact with the zonal tracers (113*a*, 113*b*, 113*c*) resulting in chemical reactions. The pieces of chemical or other materials of the zonal tracers (113*a*, 113*b*, 113*c*) are formed or otherwise formulated to react with the produced fluids to produce chemical reaction products (e.g., polymers) at respective chemical reaction efficiencies. The chemical reaction efficiency is a percentage yield of the chemical reaction. The chemical reaction products follow the flow of produced fluids to exit the enclosures (111*a*, 111*b*, 111*c*) through respective openings (112). The chemical reaction products are unique to the individual zonal tracers (113*a*, 113*b*, 113*c*) and are referred to as zonal signatures of respective zones. Each zone produces a unique zonal signature that is analyzed using the surface chemical analysis panel (136) after the production (121) flows through the wellhead (130) and reaches the surface (108). At the surface chemical analysis panel (136), the concentrations of the zonal signature unique to individual zones are determined using chemical analysis instruments.

As shown in FIG. 1A based on the legend (122), only the zonal signature of zone 3 is present in the section of the wellbore (120) between zone 2 and zone 3, i.e., downstream from zone 3 but upstream to zone 2. Both zonal signatures of zone 2 and zone 3 are present in the section of the wellbore (120) between zone 1 and zone 2, i.e., downstream from both zone 2 and zone 3 but upstream to zone 1. All three zonal signatures of zone 1, zone 2, and zone 3 are present in the remaining section of the wellbore (120) downstream from all three zones. In the production (121) downstream from all three zones and based on respective chemical reaction efficiencies of the zonal tracers (113*a*, 113*b*, 113*c*), the concentration of the zonal signature unique to zone 3 is proportional to the zonal contribution from zone 3 to the production (121), the concentration of the zonal signature unique to zone 2 is proportional to the combined zonal contributions from zone 2 and zone 3 to the production (121), the concentration of the zonal signature unique to zone 1 is proportional to the combined zonal contributions from zone 1, zone 2, and zone 3 to the production (121).

In one or more embodiments, a mathematical relationship between the zonal signatures detected at the chemical analysis panel and the individual zonal contributions from the downhole perforations can be established based on the setup where the zonal signatures are mixed in the production flow as they move upwards through the wellbore. The concentration of a zonal signature detected at the surface is a result of the contribution from the respective zone and the efficiencies of the chemical reactions that occurred. For an example system with three zones, the relationship between the concentrations and the zonal contributions is described as follows:

$$C_3 = E_3 \cdot Z_3$$

$$C_2 = E_2 \cdot (Z_2 + Z_3)$$

$$C_1 = E_1 \cdot (Z_1 + Z_2 + Z_3)$$

Where:

- $C_1$ represents the concentration of the zonal signature from zone 1 at the surface,
- $C_2$ is the concentration of the combined zonal signature from zones 2 and 3,
- $C_3$ is the concentration of the zonal signature from zone 3 alone,
- $Z_1$, $Z_2$, $Z_3$ are the individual contributions from zones 1, 2, and 3, respectively,
- $E_1$, $E_2$, $E_3$ are the efficiencies of the chemical reactions in zones 1, 2, and 3, respectively.

This set of equations assumes that there is no interaction or interference between the tracers from different zones and that the flow is sufficiently mixed such that the tracers are well distributed by the time they reach the surface panel for analysis. To solve for the individual zonal contributions (Z1, Z2, Z3), additional information or assumptions may be obtained about the system. For example, the efficiencies ($E_i$) may be determined experimentally, and the total production flow rate may be measured. With this information and the measured concentrations ($C_i$), the individual contributions may be calculated. This is a simplified model and real-world scenarios may require more complex formulations that consider factors such as tracer dilution, decay or degradation over time, non-linear mixing models, and potential interactions between tracers.

Accordingly, individual zonal contributions to the production (121) are determined by analyzing respective concentrations of the zonal signature unique to individual zones and based on respective chemical reaction efficiencies. Such analysis may be performed by the chemical analysis panel (136), by the well control system (126), or by a combination of the chemical analysis panel (136) and the well control system (126).

In some embodiments, during operation of the well system (106), the control system (126) collects and records wellhead data (140) for the well system (106). The wellhead data (140) may include, for example, a record of measurements of wellhead pressure ($P_{wh}$) (e.g., including flowing wellhead pressure), wellhead temperature ($T_{wh}$) (e.g., including flowing wellhead temperature), wellhead production rate ($Q_{wh}$) over some or all of the life of the well system (106), and water cut data. In some embodiments, the measurements are recorded in real-time, and are available for review or use within seconds, minutes or hours of the condition being sensed (e.g., the measurements are available within one minute of the condition being sensed). In such an embodiment, the wellhead data (140) may be referred to as "real-time" wellhead data (140). Real-time wellhead data (140) may enable an operator of the well system (106) to assess a relatively current state of the well system (106) and make real-time decisions regarding development of the well system (106) and the reservoir (102), such as on-demand adjustments in regulation of production flow from the well. In some embodiments, the wellhead data (140) further includes the analysis results (139*a*) from the chemical analysis panel (136), which may include historical and/or real-time concentrations of zonal signatures unique to individual zones. In some embodiments, the wellhead data (140) including the analysis results (139*a*) may be used to form a training data set to generate a machine learning (ML) model (141) for automatic control and optimization of the operation of the well system (106).

Based on the foregoing, the chemical analysis panel (136) facilitates real-time, on-site analysis of zonal inflow in oil and gas wells. The chemical tracer modules (110*a*, 110*b*, 110*c*), the chemical analysis panel (136), and the well control system (126) collectively form a closed-loop system that identifies and quantifies different zonal signatures (e.g., unique polymers) in the production fluids. This closed-loop system provides immediate data on the contribution of each production zone, enhancing decision-making and operational efficiency of the well environment (100). For example, the well control system (126) may perform an optimization algorithm using as input the analysis results (139*a*) from the chemical analysis panel (136) to generate control commands for sending to downhole control valves of the perforation zones. These control commands may adjust the downhole control valves to improve the production operation of the well environment (100). In this context, the downhole control valves are part of the closed-loop system. In some embodiments, the well control system (126) performs the optimization algorithm using the ML model (141).

Real-time information on zonal contributions may significantly improve various parameters of the production operation in an oil and gas well. Example parameters that may be optimized based on the real-time data of the zonal contributions are described below:

- Flow Rate Adjustment: Understanding the contribution from each zone can lead to better management of the overall flow rate. For instance, if a particular zone is contributing a high percentage of water (indicating water breakthrough), the flow rate from that zone can be reduced to minimize water cut.
- Well Stimulation: If real-time data indicates that a zone is underperforming, well stimulation techniques like hydraulic fracturing or acidizing can be targeted more effectively.
- EOR (Enhanced Oil Recovery) Techniques: Information about zonal contributions can inform the need for EOR techniques like gas injection or chemical flooding, optimizing their application to specific zones that require additional recovery support.
- Reservoir Management: Reservoir models can be updated with real-time zonal contribution data, improving the prediction of reservoir performance and guiding decisions on field development strategies.
- Production Optimization: By understanding the zonal contributions, operators can adjust the chokes on the well to optimize oil production while minimizing the production of unwanted gases or water.

Artificial Lift Optimization: For wells requiring artificial lift, real-time zonal data can inform the adjustment of pump rates and lift gas volumes to align with the performance of each zone.

Production Chemicals Usage: Real-time data can indicate the need for scale or corrosion inhibitors and help in optimizing the dosage based on the water or hydrocarbon contribution from each zone.

Well Integrity Management: Continuous monitoring of zonal contributions can identify potential well integrity issues, such as casing leaks, which might be indicated by sudden changes in the contributions from specific zones.

Drainage Strategy: Real-time data can help in understanding the drainage pattern in the reservoir, leading to better placement of infill wells or adjustment of existing well trajectories.

Pressure Maintenance: In fields where maintaining reservoir pressure is crucial, understanding zonal contributions can guide water or gas injection strategies to effectively support reservoir pressure.

While a few examples of how real-time zonal contribution data improves production operations are described above, specific applications and benefits may vary depending on the characteristics of the oil field, the complexity of the reservoir, and the operational goals of the monitoring project. In summary, the well environment (100) has the following features based on the closed-loop system (referred to as "the system" below):

(Closed-Loop System Path: The system includes a path for the produced fluid to enter an analysis chamber directly from the wellbore, eliminating the need for manual sampling.

Concentration Measurement: The system employs advanced sensors and detection methods to identify and measure the concentration of each polymer present in the fluid.

Computer-Based Correlation: The system uses software algorithms to correlate each polymer type with its specific production zone.

Quantitative/Qualitative Analysis: The system provides a detailed summary of each production zone, including flow rate and contribution, in both quantitative and qualitative terms.

Based on these features, the closed-loop system of the well environment (100) has the following practical applications:

Oil and Gas Production: Optimizes production strategies in oil and gas wells.

Reservoir Management: Assists in efficient reservoir management and monitoring.

Environmental Monitoring: Reduces environmental impact by minimizing the need for extraneous equipment and processes.

Figure 2:
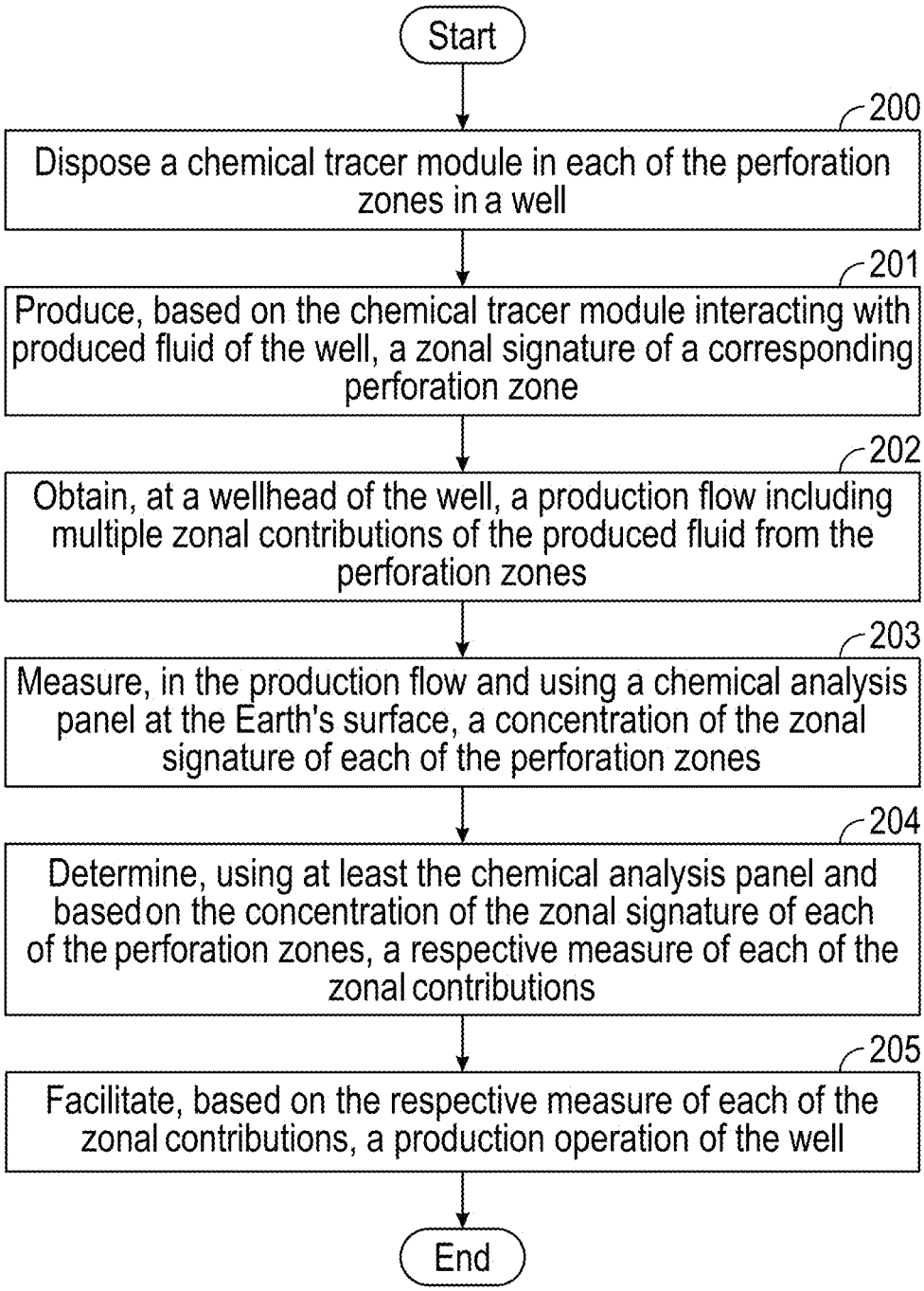
FIG. 2 shows a method flowchart in accordance with one or more embodiments.

FIG. 2 shows a method flowchart in accordance with one or more embodiments disclosed herein. The method flowchart describes a method to perform real-time zonal inflow analysis of a well. One or more of the steps in FIG. 2 may be performed by the components of the well environment (100), discussed above in reference to FIG. 1A. In one or more embodiments, one or more of the steps shown in FIG. 2 may be omitted, repeated, and/or performed in a different order than the order shown in FIG. 2. Accordingly, the scope of the disclosure should not be considered limited to the specific arrangement of steps shown in FIG. 2.

Initially in Step 200, a chemical tracer module is disposed in each of a number of perforation zones in the well. In one or more embodiments, the chemical tracer module in each of the perforation zones is integrated in a downhole completion of the well. For example, the chemical tracer module may be attached to the inner wall of the completion during initial construction of the well. In one or more embodiments, the tracer chemicals are replenishable in oil and gas wells considering operational complexities, costs, well architecture, and compliance with environmental and safety standards. Example replenishing methods are described below.

Direct Injection into the Wellbore: If the well design allows, additional tracer chemicals can be directly injected into the wellbore at the desired depth. This method may require temporary suspension of production and can be complex due to the need to accurately place the tracer at the correct depth.

Use of Retrievable Tracer Cartridges: Some tracer systems are designed with retrievable and replaceable cartridges that can be exchanged using wireline operations. This allows for the replenishment of tracer materials with minimal disruption to well operations.

Side Pocket Mandrels: For wells equipped with side pocket mandrels, tracer chemicals can be replenished by deploying new tracer capsules into the mandrel using wireline techniques. This method is relatively non-intrusive and can be performed without significant production downtime.

Downhole Chemical Injection Systems: Advanced completion systems might include dedicated chemical injection lines that allow for the periodic injection of tracer chemicals directly to the target zones from the surface. This system allows for continuous or on-demand replenishment of tracer chemicals.

Deployment of New Tracer Carriers During Well Interventions: During planned well interventions for maintenance or logging activities, new tracer carriers can be introduced into the well. Although this method involves operational downtime, it offers an opportunity to replenish tracers without additional intervention costs.

Reservoir Injection: In some cases, tracer chemicals can be injected into the reservoir through injection wells. This method is more applicable for inter-well tracer studies but might be used for specific tracer applications where direct access to the production well is not feasible.

Each of these methods involves trade-offs between the complexity of operation, cost, and the potential for production downtime. The choice of replenishment method will depend on the specific requirements of the well and the tracer system, as well as operational priorities such as minimizing downtime and ensuring the accuracy of tracer data. The operation to replenish tracer chemicals adheres to environmental regulations and safety standards to prevent any adverse effects on the reservoir, production fluids, or the environment. This includes selecting tracers that are compatible with the reservoir conditions and production fluids, ensuring that the introduction of new tracers does not disrupt the well or reservoir integrity, and monitoring for any unexpected environmental impact.

In Step 201, a zonal signature (i.e., a chemical reaction product) of each of the perforation zones is produced when the chemical tracer module (more specifically the zonal tracer contained therein) interacts with produced fluid of the well. The zonal tracer is a chemical unique to each perforation zone, therefore the zonal signature uniquely identifies the corresponding perforation zone.

In Step 202, a production flow is obtained at a wellhead of the well. The production flow includes multiple zonal contributions of the produced fluid from the perforation zones.

In Step 203, a concentration of the zonal signature of each of the perforation zones is measured in the production flow using a chemical analysis panel located at the Earth's surface. In one or more embodiment, the zonal signatures and the respective concentrations are detected and measured using chemical analysis instruments of the chemical analysis panel. For example, a representative sample of the production flow may be diverted from the wellhead into an analysis chamber of the chemical analysis instrument (e.g., a mass spectrometer) without human intervention.

In Step 204, a respective measure of each of the zonal contributions is determined using at least the chemical analysis panel and based on the concentration of the zonal signature of each of the perforation zones. FIG. 1C above illustrates an interface or graphical user interface (GUI) of a chemical analysis panel with clear sections for displaying real-time data.

In one or more embodiments, the respective measure corresponds to a percentage contribution of produced fluid from each of the perforation zones. In one or more embodiments, the respective measure is determined within a pre-determined time (e.g., one minute) after the chemical analysis panel obtains the production flow from the wellhead so as to perform the zonal inflow analysis in real-time.

In Step 205, a production operation of the well is facilitated based on the respective measure of each of the zonal contributions. In one or more embodiments, at least one control command is generated by a well control system based on the respective measure of each of the zonal contributions. The well control system sends the control commands to corresponding downhole control valves to adjust the production flow. Each control command causes the corresponding downhole control valve to adjust at least one of the zonal contributions. In one or more embodiments, the control command is sent within a pre-determined time (e.g., one minute) after the chemical analysis panel obtains the production flow from the wellhead for analysis so as to adjust the production flow in real-time.

In one or more embodiments, manual sampling and laboratory analysis of the produced fluid in the production flow is eliminated by using a chemical analysis panel at the Earth's surface to automatically measure the concentration of the zonal signature of each of the perforation zones. Eliminating the manual sampling and laboratory analysis at the surface prevents release of hazardous downhole gases, thereby enhancing operational efficiency and safety of the production operation.

FIGS. 3A-3J show an implementation example in accordance with one or more embodiments. The example shown in FIGS. 3A-3J illustrate the closed-loop system (i.e., the chemical tracer modules, the chemical analysis panel, the well control system, and the downhole control valves) described in reference to FIG. 1A above. In particular, FIGS. 3A-3J illustrate the closed-loop system highlighting the following features:

- Real-Time Analysis: Unlike the other methods that may require manual sample collection and delayed analysis, the closed-loop system provides immediate, on-site analysis of zonal contributions.
- Direct Interface: The closed-loop system directly interfaces with the well's output, eliminating manual sampling and associated risks or inaccuracies.
- Direct Fluid-Tracer Interaction: The closed-loop system uses tracers that react with the produced fluids in real-time within the well, providing more precise data than methods that rely on post-collection analysis.
- Integrated Tracers in Well Completion: Tracers are part of the well's construction as opposed to other methods that may introduce tracers or measurement tools separately.
- Computer-Based Correlation: The closed-loop system employs sophisticated software to link detected polymers to specific production zones, a feature that enhances data interpretation beyond traditional analysis methods.
- Enhanced Safety and Environmental Compliance: By avoiding well interventions, the closed-loop system mitigates safety risks and environmental concerns related to manual fluid handling and wellbore intrusion.
- Adaptability to Various Well Conditions: The real-time zonal inflow analyzer with closed-loop tracer system work effectively in diverse operational scenarios, including those with hazardous gases, thus reducing limitations due to operational environment.
- Non-Intrusiveness: The real-time zonal inflow analyzer with closed-loop tracer system's measurements are obtained without interfering with the well conditions, providing an advantage over other production logging tools (PLTs) that physically enter the wellbore.

TABLE 1 shows the chemical reaction efficiency (i.e., percentage yield) of different tracer types in reacting with various types of produced fluids, such as oil, water, and gas.

TABLE 1

| Tracer Type | Fluid Type | Efficiency (%) |
|---|---|---|
| Tracer A | Oil | 95% |
| Tracer A | Water | 88% |
| Tracer A | Gas | 90% |
| Tracer B | Oil | 92% |
| Tracer B | Water | 85% |
| Tracer B | Gas | 93% |
| Tracer C | Oil | 89% |
| Tracer C | Water | 91% |
| Tracer C | Gas | 87% |

Examples of tracers A, B, and C reacting with various types of produced fluids, such as oil, water, and gas, could be based on their unique chemical properties and how they interact with different fluid phases to produce detectable signals. These tracers are designed to provide information about the flow and composition within the reservoir, helping to identify the source of production fluids and the efficiency of recovery processes. Here are hypothetical examples based on their interaction with oil, water, and gas:

Tracer A—Oil-Soluble Tracer

- Chemical Composition: Fluorinated aromatic compound, designed for high solubility in oil phases.
- Reaction Efficiency in Oil: High (95%), indicating a strong response when dissolved in oil, making it ideal for tracking oil flow from specific reservoir zones.

Reaction Efficiency in Water: Low (10%), indicating minimal interaction with water, thus ensuring its specificity for oil.

Reaction Efficiency in Gas: Moderate (50%), due to partial volatility, it can also be used to trace gas condensate zones.

Tracer B—Water-Soluble Tracer

Chemical Composition: Salt of a carboxylic acid, selected for its high solubility in water.

Reaction Efficiency in Oil: Low (5%), indicating it does not dissolve well in oil, making it specific for water tracing.

Reaction Efficiency in Water: High (98%), showing excellent solubility and making it ideal for monitoring water injection fronts and identifying breakthrough zones.

Reaction Efficiency in Gas: Low (10%), indicating minimal interaction with gas phases.

Tracer C—Gas-Specific Tracer

Chemical Composition: Volatile organic compound with a unique molecular structure that allows it to be carried with gas phases without dissolving in liquids.

Reaction Efficiency in Oil: Very Low (2%), indicating it does not dissolve in oil.

Reaction Efficiency in Water: Very Low (3%), indicating it does not dissolve in water.

Reaction Efficiency in Gas: High (90%), making it highly effective for tracking gas movement through the reservoir.

The choice of tracer depends on the specific objectives of the reservoir monitoring program, including whether the focus is on oil, water, or gas production. The efficiency percentages provided are hypothetical and illustrate how different tracers are selectively responsive to the fluid phases they are intended to monitor. Real applications would require laboratory testing and field trials to determine the exact efficiencies of these tracers under specific reservoir conditions.

Figure 3A:
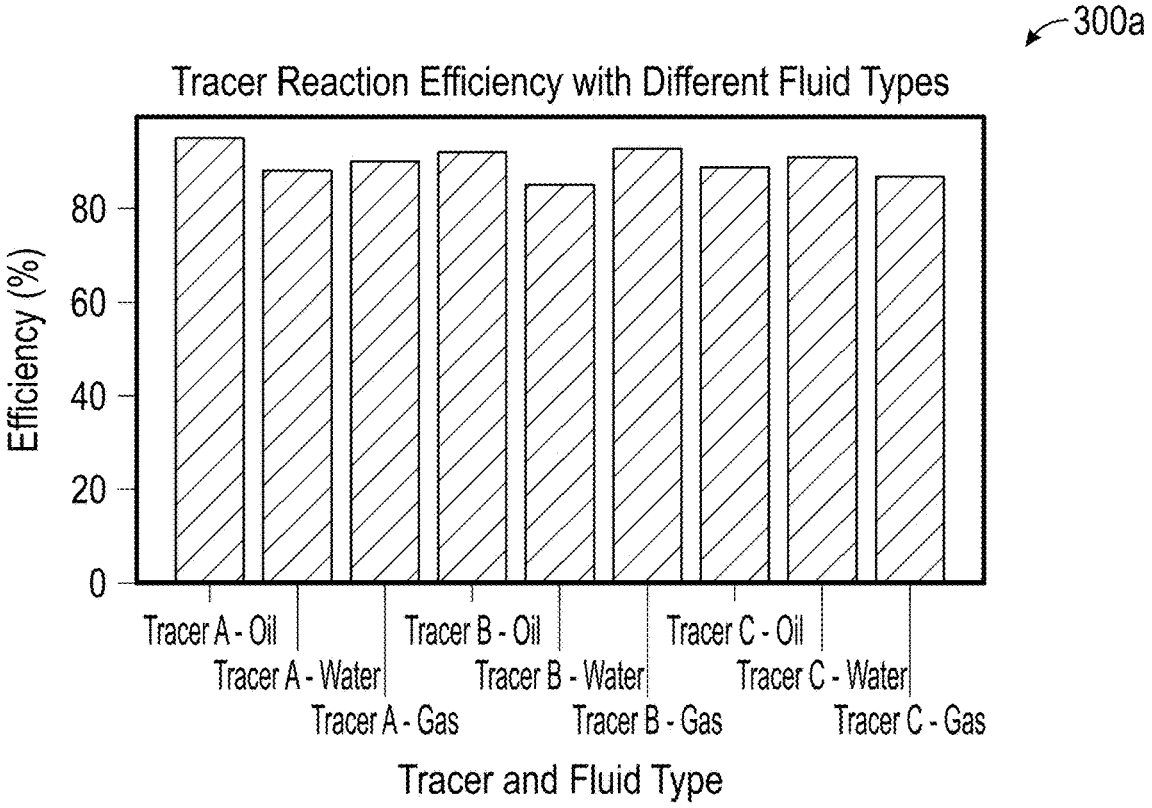
FIGS. 3A-3J show an example in accordance with one or more embodiments.

FIG. 3A shows a bar graph (300*a*) representing data for the chemical reaction efficiency of different tracer types in reacting with various types of produced fluids. As illustrated by TABLE and FIG. 3A, the chemical reaction is a key factor in determining the suitability of a tracer for a specific application in the oil and gas industry.

Figure 3B:
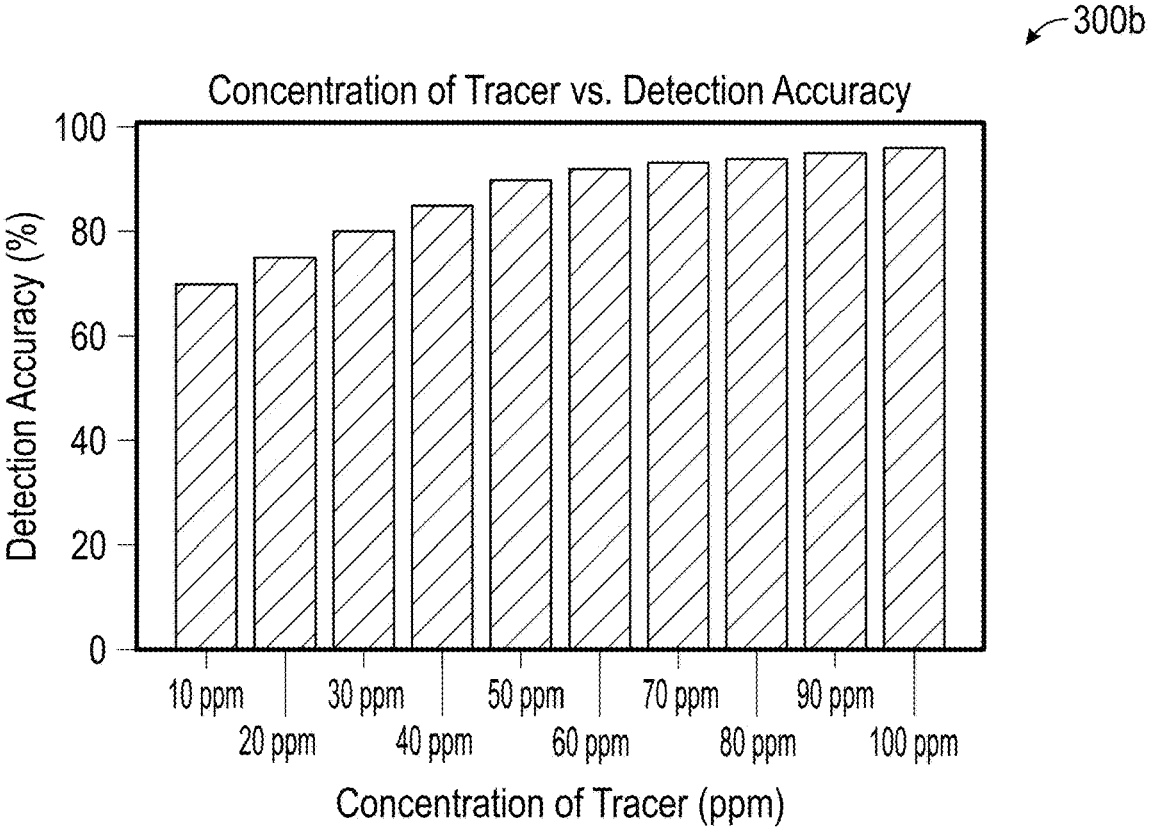

FIG. 3B shows a bar graph (300*b*) representing data for the sensitivity and accuracy of the chemical analysis panel in detecting different concentrations of tracers. As shown in FIG. 3B, the horizontal axis corresponds to the detected concentration of polymers (ppm) and the vertical axis corresponds to the detection accuracy (%). The data trend depicted in FIG. 3B indicates that the chemical analysis panel is more sensitive and accurate at higher tracer concentrations, which is a critical aspect in evaluating the performance of such analysis systems in the oil and gas industry.

TABLE 2 illustrates how the closed-loop system performs the real-time zonal inflow analysis under various flow rates, fluid compositions, temperatures, and pressures, which are typical in normal well conditions.

TABLE 2

| Flow Rate (bbl/day) | Fluid Composition | Temperature (° C.) | Pressure (psi) | System Accuracy (%) | System Response Time (seconds) |
|---|---|---|---|---|---|
| 1,000 | Oil-Dominant | 40 | 1,500 | 92 | 30 |

TABLE 2-continued

| Flow Rate (bbl/day) | Fluid Composition | Temperature (° C.) | Pressure (psi) | System Accuracy (%) | System Response Time (seconds) |
|---|---|---|---|---|---|
| 1,500 | Water-Dominant | 50 | 2,000 | 90 | 28 |
| 2,000 | Gas-Dominant | 60 | 2,500 | 93 | 25 |
| 2,500 | Mixed | 70 | 3,000 | 91 | 27 |
| 3,000 | Oil-Dominant | 80 | 3,500 | 94 | 24 |
| 3,500 | Water-Dominant | 90 | 4,000 | 89 | 30 |
| 4,000 | Gas-Dominant | 100 | 4,500 | 95 | 22 |
| 4,500 | Mixed | 110 | 5,000 | 92 | 26 |
| 5,000 | Oil-Dominant | 120 | 5,500 | 96 | 20 |
| 5,500 | Water-Dominant | 130 | 6,000 | 88 | 32 |

As shown in TABLE 2, the production flow rate varies from 1,000 to 5,500 barrels per day, the fluid composition includes oil-dominant, water-dominant, gas-dominant, and mixed types, the temperature and pressure ranges are typical for oil and gas wells, the system accuracy percentage indicates the accuracy of the system under these conditions, and the system response time represents the time taken by the system to provide accurate readings after detecting changes in conditions. In summary, TABLE 2 provides a comprehensive view of how the closed-loop system performs vary under different operational scenarios, highlighting the versatility and reliability in diverse well conditions.

Figure 3C:
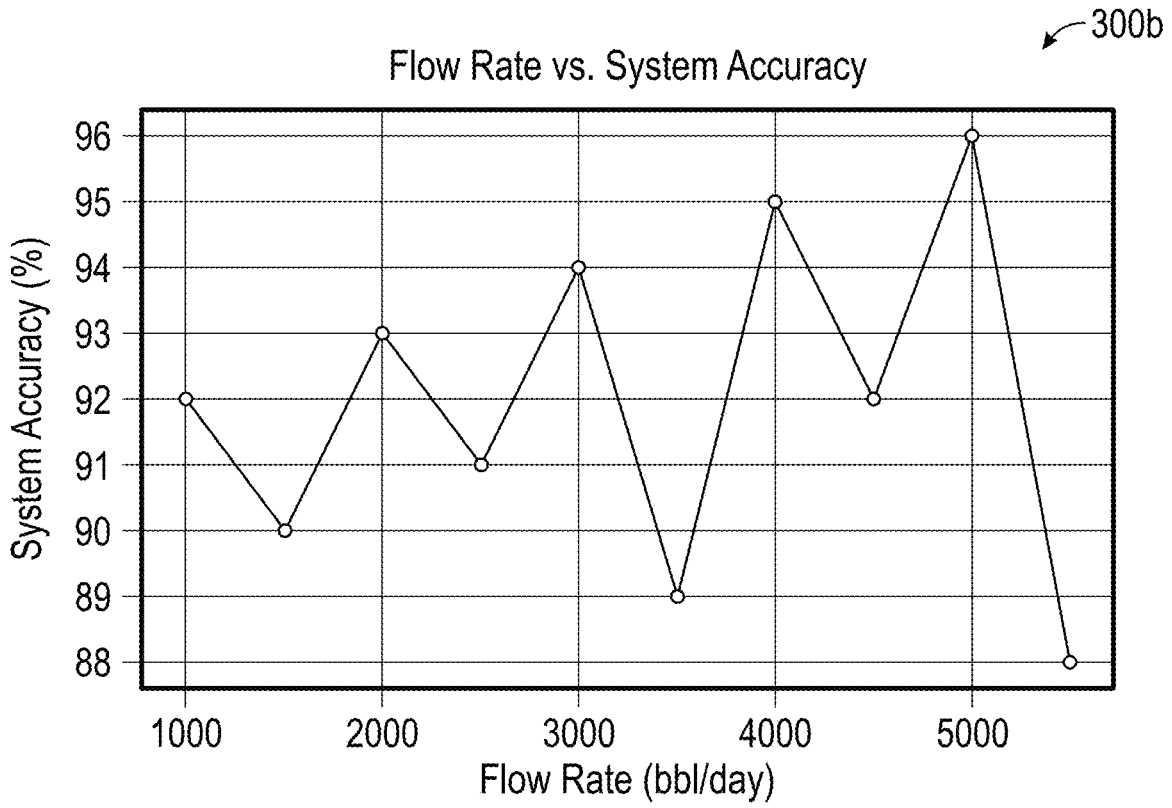
Figure 3D:
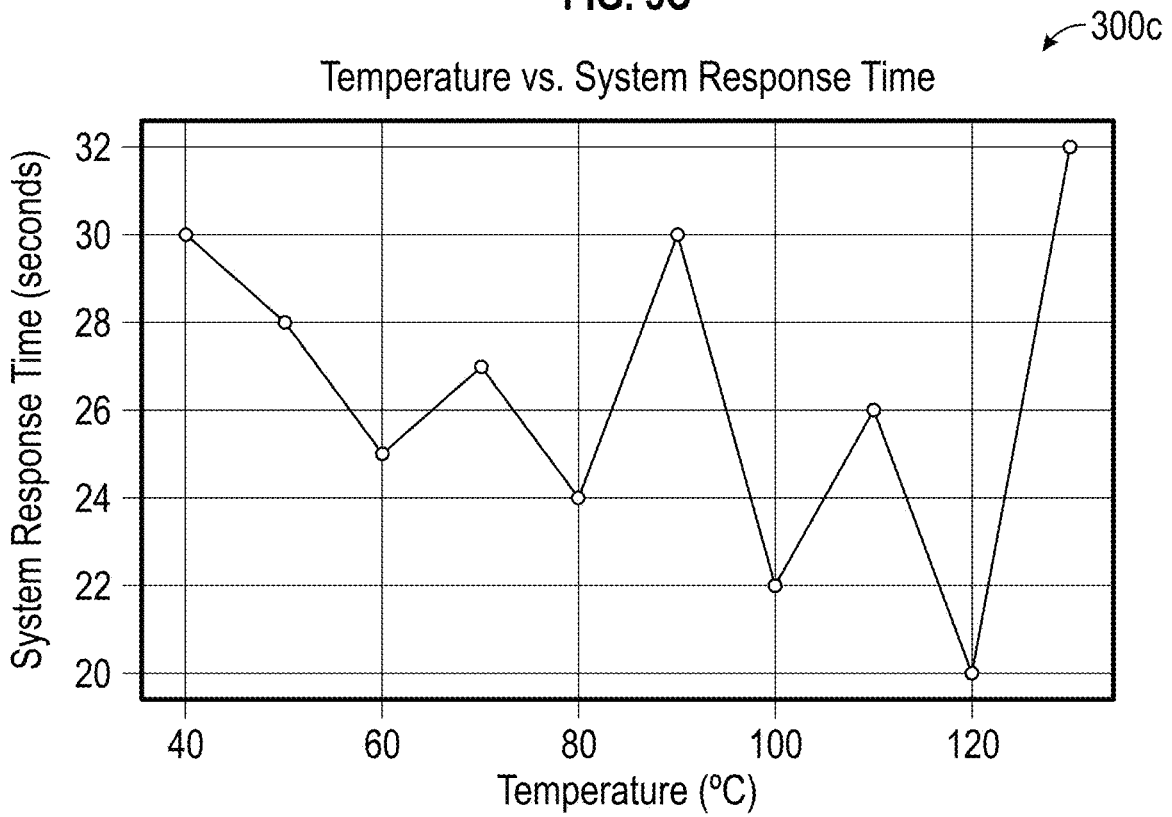

FIG. 3C shows a data plot (300*c*) of the flow rates against the system accuracy percentages, showing how accuracy varies with different flow rates. FIG. 3D shows a data plot of the temperatures against the system response times, illustrating the relationship between operational temperature and response time.

Figure 3E:
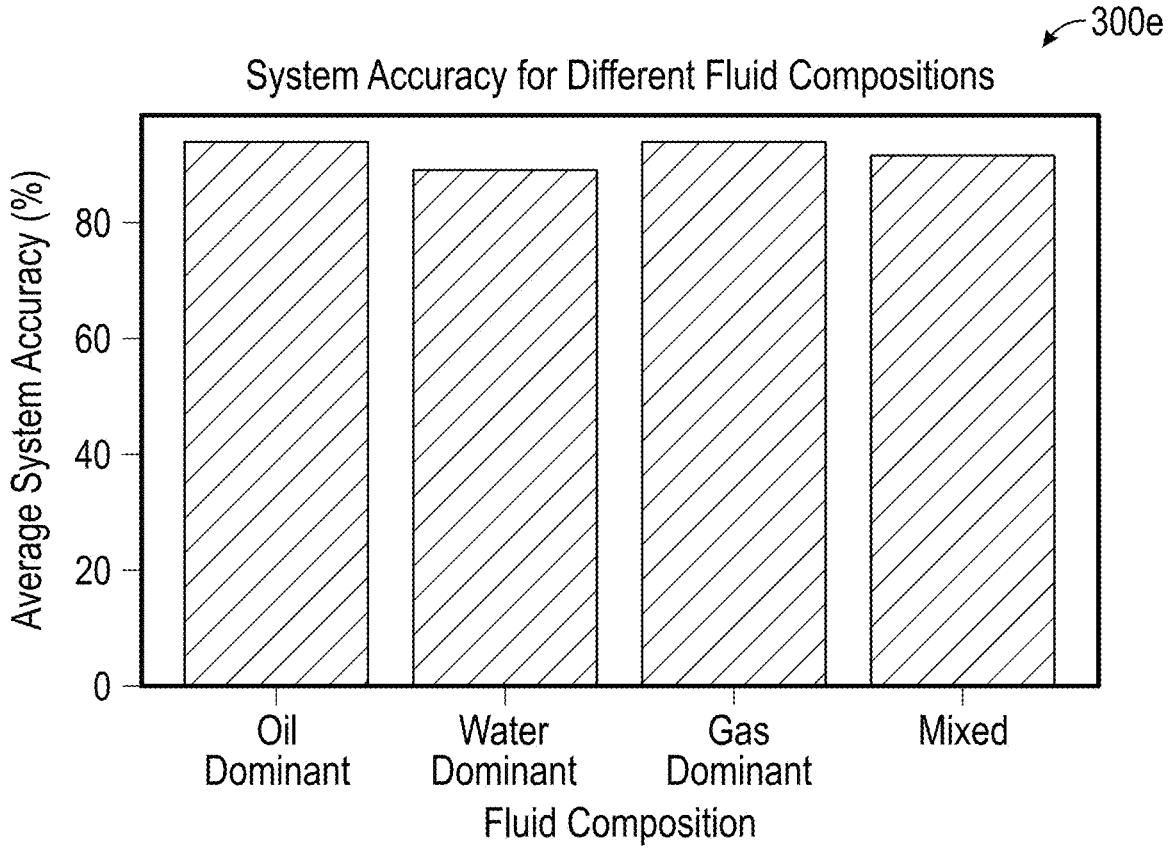

FIG. 3E shows a bar chart (300*e*) providing a visual comparison of two key performance metrics of a closed-loop system used in oil and gas operations. The data plot compares the accuracy of the system when dealing with different types of fluids, such as oil-dominant, water-dominant, gas-dominant, and mixed. Each bar represents the average accuracy percentage for the system when handling each fluid type. This visualization is crucial for the wellsite operator to understand how well the system performs across various fluid compositions, which is essential for optimizing operations and decision-making in diverse well conditions.

Figure 3F:
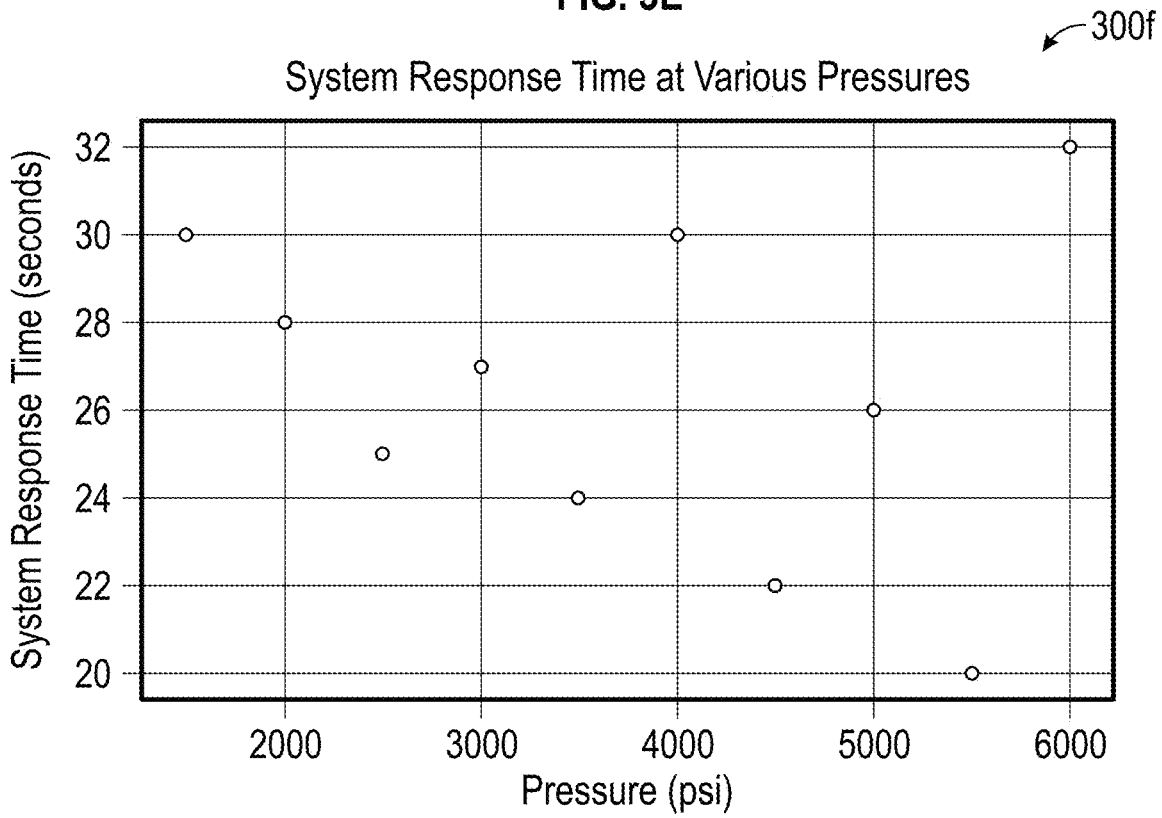

FIG. 3F shows a scatter plot (300*f*) of system response time at various pressure. The scatter plot serves as a visual tool for the wellsite operator to analyze the relationship between operational pressure and the response time of a system in oil and gas operations. Each point on the scatter plot represents a unique combination of pressure (in psi) and response time (in seconds). This visualization is crucial for identifying how the system's responsiveness is influenced by varying pressure levels, which is a key factor in ensuring efficiency and safety in oil and gas extraction environments. The plot is particularly useful for spotting trends or anomalies, helping operators and engineers make informed decisions about system performance under different pressure conditions.

In combination, FIGS. 3E and 3F are instrumental in evaluating the system's adaptability and performance, ensuring it meets the demanding requirements of the oil and gas industry.

Figure 3G:
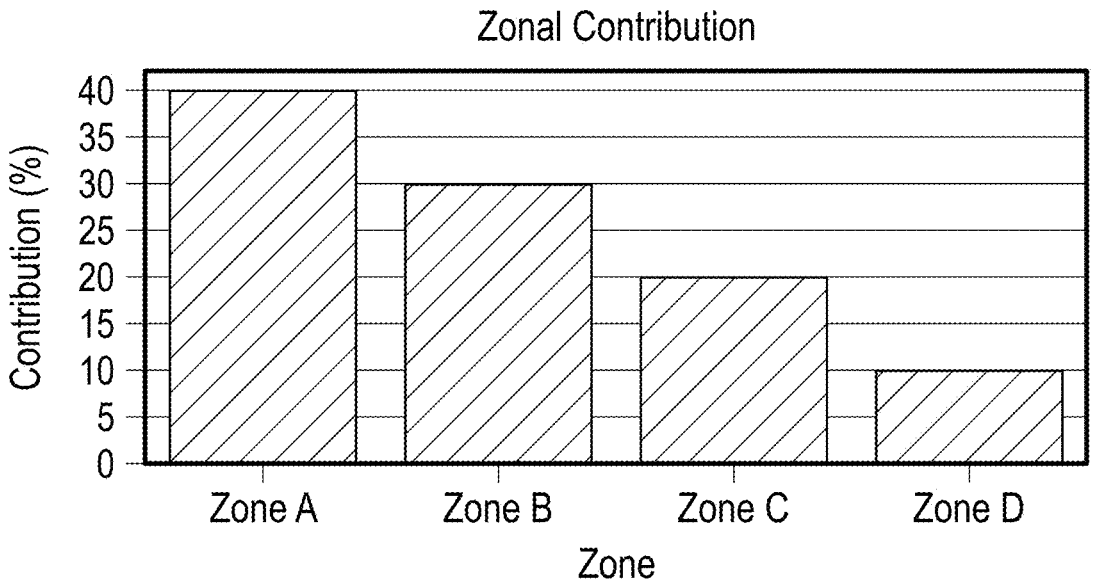
Figure 3H:
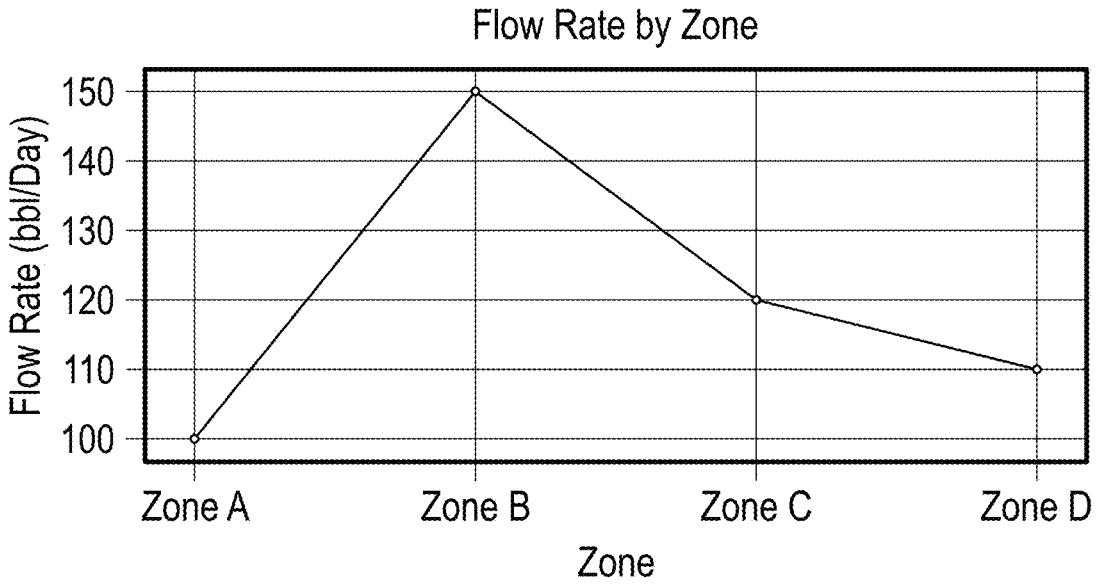

FIG. 3G shows a bar chart (300*g*) that illustrates the zonal contribution per interval. For example, Zone A, Zone B, and Zone C in the bar chart (300*g*) may correspond to Zone I (100*a*), Zone II (100*b*), and Zone III (100*c*) depicted in FIG. 1A above. FIG. 3H shows a data plot (300*h*) that illustrates the flowrate contributions depicted in FIG. 3G in a line plot format.

Figure 3I:
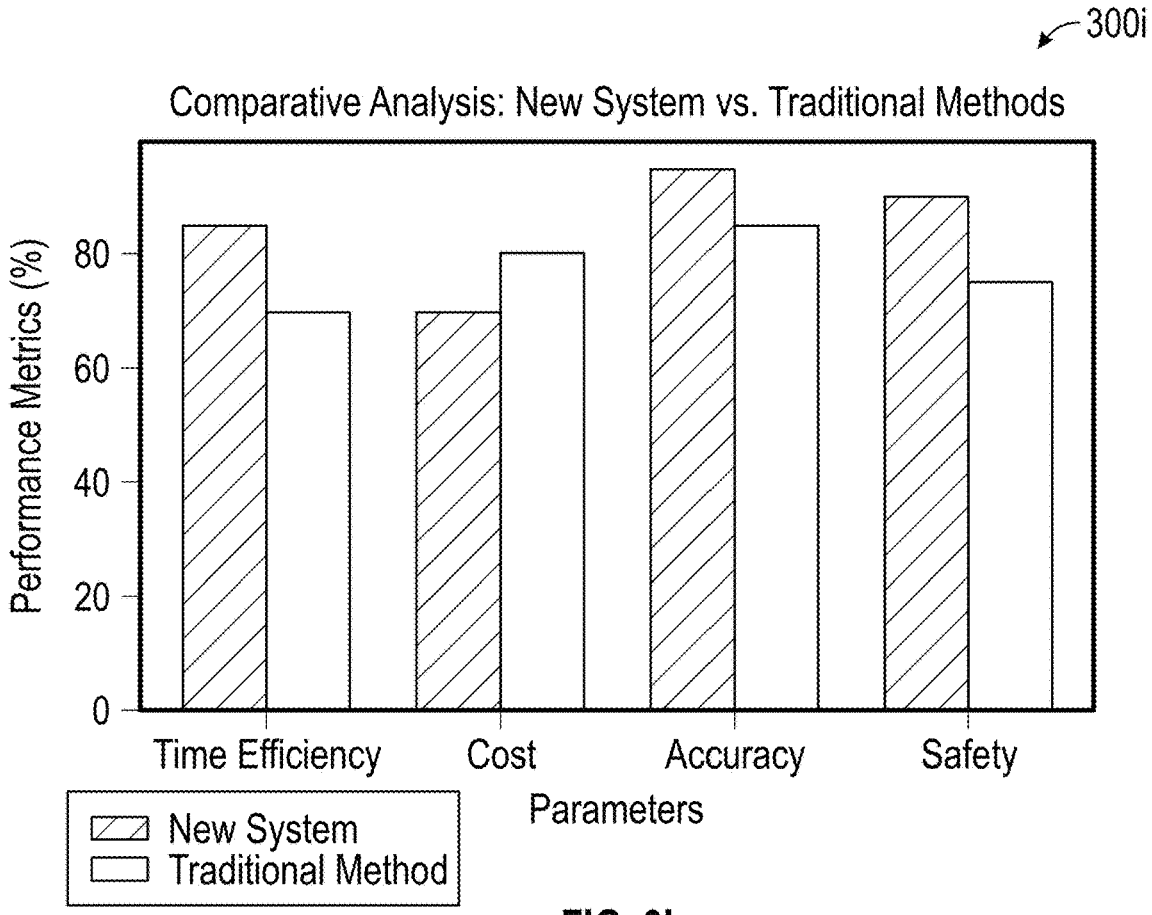

FIG. 3I shows a bar chart (300*i*) that illustrates a comparison between the performance of the closed-loop system depicted in FIG. 1A against traditional methods across various operational parameters, i.e., time efficiency, cost, accuracy, and safety. In particular, the vertical axis corresponds to performance metrics as percentages, indicating how well each system performs in each parameter.

Figure 3J:
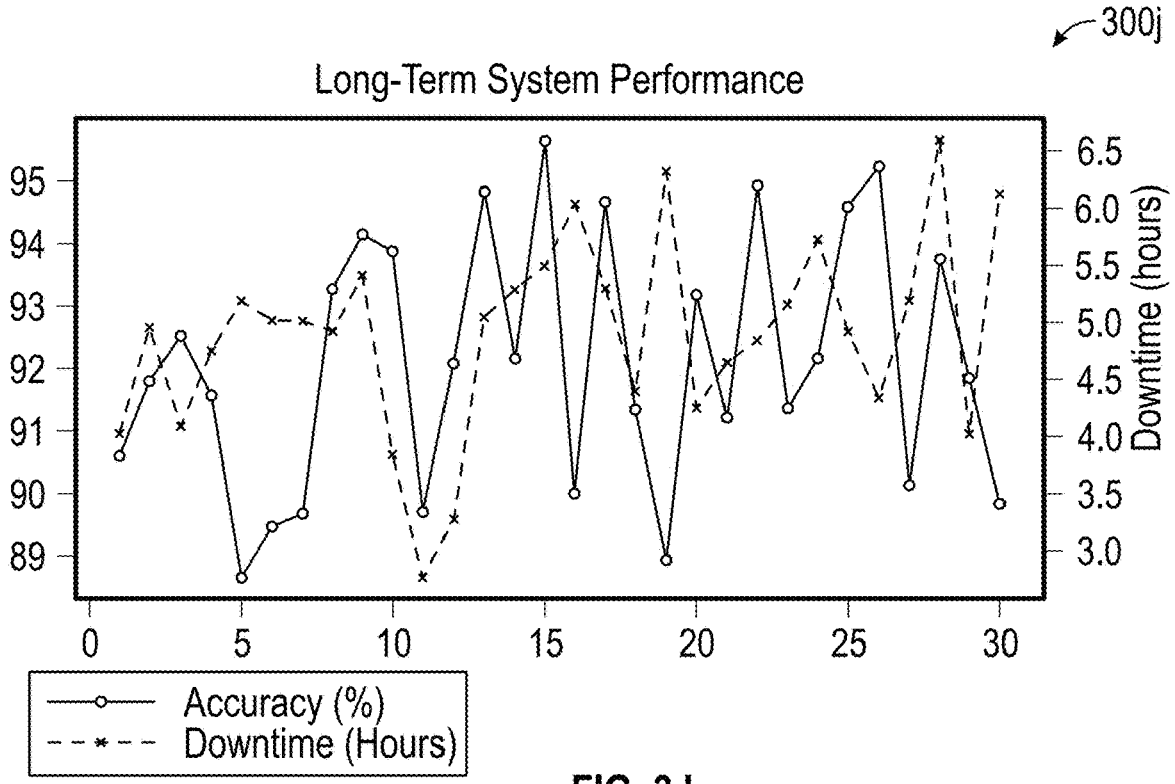

FIG. 3J shows a line chart (300*j*) to illustrates to the reliability and consistency of a system's performance over an extended period. In particular, the horizontal axis corresponds to a time frame over 30 days showing the daily performance of the system. The vertical axis corresponds to the system accuracy and system downtime. Fluctuations in system accuracy indicate changes in how accurately the system performs its functions on a day-to-day basis. The downtime represents when the system is not operational or is undergoing maintenance. The line chart (300*p*) is particularly useful for the user to monitor long-term trends in system performance, such as improving or degrading accuracy, or changes in the frequency or duration of downtimes.

By analyzing the data shown in FIGS. 3A-3J above, operators and engineers can identify patterns or irregularities, assess the system's overall stability, and make informed decisions about maintenance, upgrades, or operational adjustments.

Embodiments disclosed herein revolutionize the process of determining chemical tracer contributions in each zone by introducing a closed-loop system equipped with a chemical analysis panel. This system is designed to directly identify the components of the fluid, specifically the type and concentration of polymers, thereby facilitating on-site, real-time analysis of zonal contributions along with a live monitoring dashboard.

Advantageously, the system disclosed herein allows the produced fluid to flow directly into an analysis chamber, bypassing the need for manual sampling. This increases the operational efficiency and reduces risks. The system employs sophisticated techniques to measure or detect the concentration of each polymer present in the fluid, offering an alternative to traditional identification methods, and providing immediate insights into zonal contributions. Utilizing a computerized system, embodiments disclosed herein correlate each detected polymer with its corresponding production zone, enhancing the accuracy of zonal contribution data. The system provides a detailed quantitative and qualitative summary of each production zone, including its contribution to the overall flow. Applications of this system include managing and optimizing reservoir performance by providing real-time data on fluid contributions from different zones. It is useful in making informed operational decisions in both onshore and offshore drilling environments. The system can be employed in environmental monitoring, ensuring compliance with industry regulations and standards.

Figure 4:
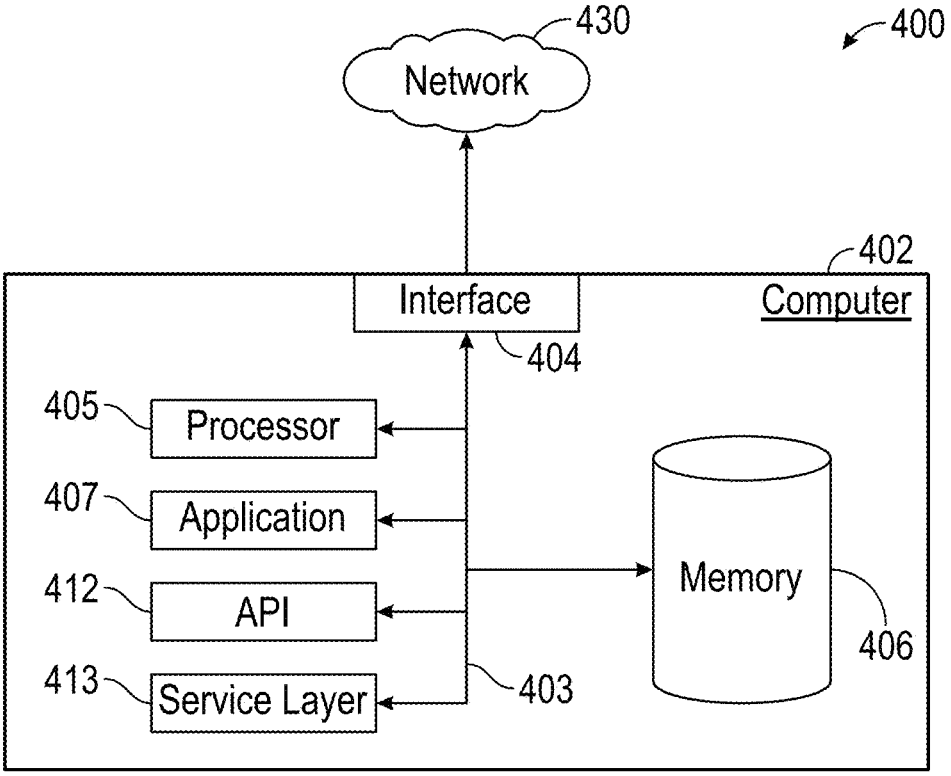
FIG. 4 shows a computing system in accordance with one or more embodiments.

Embodiments may be implemented on a computer system. FIG. 4 is a block diagram of a computer system (402) used to provide computational functionalities associated with described algorithms, methods, functions, processes, flows, and procedures as described in the instant disclosure, according to an implementation. The illustrated computer (402) is intended to encompass any computing device such as a high-performance computing (HPC) device, a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer (402) may include a computer that includes an input device, such as a keypad, keyboard, touch screen, or other device that can accept user information, and an output device that conveys information associated with the operation of the computer (402), including digital data, visual, or audio information (or a combination of information), or a GUI.

The computer (402) can serve in a role as a client, network component, a server, a database or other persistency, or any other component (or a combination of roles) of a computer system for performing the subject matter described in the instant disclosure. The illustrated computer (402) is communicably coupled with a network (430). In some implementations, one or more components of the computer (402) may be configured to operate within environments, including cloud-computing-based, local, global, or other environment (or a combination of environments).

At a high level, the computer (402) is an electronic computing device operable to receive, transmit, process, store, or manage data and information associated with the described subject matter. According to some implementations, the computer (402) may also include or be communicably coupled with an application server, e-mail server, web server, caching server, streaming data server, business intelligence (BI) server, or other server (or a combination of servers).

The computer (402) can receive requests over network (430) from a client application (for example, executing on another computer (402)) and responding to the received requests by processing the said requests in an appropriate software application. In addition, requests may also be sent to the computer (402) from internal users (for example, from a command console or by other appropriate access method), external or third-parties, other automated applications, as well as any other appropriate entities, individuals, systems, or computers.

Each of the components of the computer (402) can communicate using a system bus (403). In some implementations, any or all of the components of the computer (402), both hardware or software (or a combination of hardware and software), may interface with each other or the interface (404) (or a combination of both) over the system bus (403) using an application programming interface (API) (412) or a service layer (413) (or a combination of the API (412) and service layer (413). The API (412) may include specifications for routines, data structures, and object classes. The API (412) may be either computer-language independent or dependent and refer to a complete interface, a single function, or even a set of APIs. The service layer (413) provides software services to the computer (402) or other components (whether or not illustrated) that are communicably coupled to the computer (402). The functionality of the computer (402) may be accessible for all service consumers using this service layer. Software services, such as those provided by the service layer (413), provide reusable, defined business functionalities through a defined interface. For example, the interface may be software written in JAVA, C++, or other suitable language providing data in extensible markup language (XML) format or other suitable format. While illustrated as an integrated component of the computer (402), alternative implementations may illustrate the API (412) or the service layer (413) as stand-alone components in relation to other components of the computer (402) or other components (whether or not illustrated) that are communicably coupled to the computer (402). Moreover, any or all parts of the API (412) or the service layer (413) may be implemented as child or sub-modules of another software module, enterprise application, or hardware module without departing from the scope of this disclosure.

The computer (402) includes an interface (404). Although illustrated as a single interface (404) in FIG. 4, two or more interfaces (404) may be used according to particular needs, desires, or particular implementations of the computer (402). The interface (404) is used by the computer (402) for communicating with other systems in a distributed environment that are connected to the network (430). Generally, the interface (404) includes logic encoded in software or hardware (or a combination of software and hardware) and operable to communicate with the network (430). More specifically, the interface (404) may include software supporting one or more communication protocols associated with communications such that the network (430) or interface's hardware is operable to communicate physical signals within and outside of the illustrated computer (402).

The computer (402) includes at least one computer processor (405). Although illustrated as a single computer processor (405) in FIG. 4, two or more processors may be used according to particular needs, desires, or particular implementations of the computer (402). Generally, the computer processor (405) executes instructions and manipulates data to perform the operations of the computer (402) and any algorithms, methods, functions, processes, flows, and procedures as described in the instant disclosure.

The computer (402) also includes a memory (406) that holds data for the computer (402) or other components (or a combination of both) that can be connected to the network (430). For example, memory (406) can be a database storing data consistent with this disclosure. Although illustrated as a single memory (406) in FIG. 4, two or more memories may be used according to particular needs, desires, or particular implementations of the computer (402) and the described functionality. While memory (406) is illustrated as an integral component of the computer (402), in alternative implementations, memory (406) can be external to the computer (402).

The application (407) is an algorithmic software engine providing functionality according to particular needs, desires, or particular implementations of the computer (402), particularly with respect to functionality described in this disclosure. For example, application (407) can serve as one or more components, modules, applications, etc. Further, although illustrated as a single application (407), the application (407) may be implemented as multiple applications (407) on the computer (402). In addition, although illustrated as integral to the computer (402), in alternative implementations, the application (407) can be external to the computer (402).

There may be any number of computers (402) associated with, or external to, a computer system containing computer (402), each computer (402) communicating over network (430). Further, the term "client," "user," and other appropriate terminology may be used interchangeably as appropriate without departing from the scope of this disclosure. Moreover, this disclosure contemplates that many users may use one computer (402), or that one user may use multiple computers (402).

In some embodiments, the computer (402) is implemented as part of a cloud computing system. For example, a cloud computing system may include one or more remote servers along with various other cloud components, such as cloud storage units and edge servers. In particular, a cloud computing system may perform one or more computing operations without direct active management by a user device or local computer system. As such, a cloud computing system may have different functions distributed over multiple locations from a central server, which may be performed using one or more Internet connections. More specifically, cloud computing system may operate according to one or more service models, such as infrastructure as a service (IaaS), platform as a service (PaaS), software as a service (SaaS), mobile "backend" as a service (MBaaS), serverless computing, artificial intelligence (AI) as a service (AIaaS), and/or function as a service (FaaS).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed:

1. A chemical analysis panel for performing zonal inflow analysis of a well, comprising:

an automated instrument disposed at the Earth's surface that:

obtains, at a wellhead of the well, a production flow comprising a plurality of zonal contributions of produced fluid from a plurality of perforation zones in the well;

measures, in the production flow, a concentration of a zonal signature of each of the plurality of perforation zones; and determines, based on the concentration of the zonal signature of each of the plurality of perforation zones, a respective measure of each of the plurality of zonal contributions, wherein a chemical tracer module is disposed in each of the plurality of perforation zones that interacts with the produced fluid to produce the zonal signature of a corresponding perforation zone, the zonal signature comprising a chemical reaction product of the chemical tracer module and the produced fluid to uniquely identify the corresponding perforation zone; and an integrated monitoring dashboard that displays the respective measure of each of the plurality of zonal contributions to facilitate a production operation of the well.

2. The chemical analysis panel of claim 1, wherein the chemical tracer module in each of the plurality of perforation zones is integrated in a downhole completion of the well.

3. The chemical analysis panel of claim 1, wherein said facilitating the production operation of the well comprises:

generating, by a well control system of the well and based on the respective measure of each of the plurality of zonal contributions, at least one control command; and sending, from the well control system to at least one downhole control valve, the at least one control command to adjust the production flow.

4. The chemical analysis panel of claim 3, wherein the at least one control command causes the at least one downhole control valve to adjust at least one of the plurality of zonal contributions.

5. The chemical analysis panel of claim 3, wherein the at least one control command is sent within a pre-determined time from said obtaining the production flow to adjust the production flow in real-time.

6. The chemical analysis panel of claim 3, wherein the chemical tracer module, the automated instrument, and the well control system collectively form a closed-loop system that is adaptable to a plurality of downhole pressures and flow rates of the produced fluid in the well, wherein the automated instrument further determines a flow rate of the production flow and a measurement accuracy metric of the closed-loop system, and wherein the integrated monitoring dashboard further displays the flow rate and the measurement accuracy metric to facilitate the production operation of the well.

7. The chemical analysis panel of claim 3, wherein said facilitating the production operation of the well further comprises:

eliminating, by said automated instrument disposed at the Earth's surface to measure the concentration of the zonal signature of each of the plurality of perforation zones, manual sampling and laboratory analysis of the produced fluid in the production flow; and preventing, by at least said eliminating the manual sampling and laboratory analysis, release of hazardous downhole gases, thereby enhancing operational efficiency and safety of the production operation.

8. A real-time zonal inflow analysis system, comprising:

a chemical tracer module disposed in each of a plurality of perforation zones in a well, wherein the chemical tracer module interacts with produced fluid of the well to produce a zonal signature of a corresponding perforation zone, the zonal signature comprising a chemical reaction product of the chemical tracer module and the produced fluid to uniquely identify the corresponding perforation zone;

a chemical analysis panel disposed at the Earth's surface and comprising:

an automated instrument that obtains, at a wellhead of the well, a production flow comprising a plurality of zonal contributions of the produced fluid from the plurality of perforation zones;

measures, in the production flow, a concentration of the zonal signature of each of the plurality of perforation zones; and determines, based on the concentration of the zonal signature of each of the plurality of perforation zones, a respective measure of each of the plurality of zonal contributions; and an integrated monitoring dashboard that displays the respective measure of each of the plurality of zonal contributions to facilitate a production operation of the well.

9. The real-time zonal inflow analysis system of claim 8, wherein the chemical tracer module in each of the plurality of perforation zones is integrated in a downhole completion of the well.

10. The real-time zonal inflow analysis system of claim 8, further comprising a well control system that controls the production operation by at least:

generating, based on the respective measure of each of the plurality of zonal contributions, at least one control command; and sending, to at least one downhole control valve, the at least one control command to adjust the production flow.

11. The real-time zonal inflow analysis system of claim 10, wherein well control system adjusts the production flow in real-time by sending the at least one control command within a pre-determined time from the automated instrument obtaining the production flow.

12. The real-time zonal inflow analysis system of claim 10, wherein the chemical tracer module, the automated instrument, and the well control system collectively form a closed-loop system that is adaptable to a plurality of downhole pressures and flow rates of the produced fluid in the well, wherein the automated instrument further determines a flow rate of the production flow and a measurement accuracy metric of the closed-loop system, and wherein the integrated monitoring dashboard further displays the flow rate and the measurement accuracy metric to facilitate the production operation of the well.

13. The real-time zonal inflow analysis system of claim 10, wherein said facilitating the production operation of the well further comprises:

eliminating, by said automated instrument disposed at the Earth's surface to measure the concentration of the zonal signature of each of the plurality of perforation zones, manual sampling and laboratory analysis of the produced fluid in the production flow; and preventing, by at least said eliminating the manual sampling and laboratory analysis, release of hazardous downhole gases, thereby enhancing operational efficiency and safety of the production operation.

* * * * *